United States Patent [19]

King

[11] 3,986,474

[45] Oct. 19, 1976

[54] BOAT STAY FASTENING

[75] Inventor: Kenneth L. King, Maynard, Mass.

[73] Assignee: Navtec, Inc., Maynard, Mass.

[22] Filed: June 27, 1975

[21] Appl. No.: 591,017

[52] U.S. Cl. ..... 114/90

[51] Int. Cl.[2] ..... B63B 15/02

[58] Field of Search ..... 114/102, 109, 90, 94; 403/115, 90, 131

[56] References Cited

UNITED STATES PATENTS

| | | | |
|---|---|---|---|
| 2,984,199 | 5/1961 | Giewald | 114/90 X |
| 3,851,979 | 12/1974 | Becker | 403/165 X |

FOREIGN PATENTS OR APPLICATIONS

| | | | |
|---|---|---|---|
| 787,237 | 2/1936 | France | 114/102 |
| 1,050,918 | 12/1966 | United Kingdom | 114/90 |

*Primary Examiner*—Stephen G. Kunin
*Assistant Examiner*—Gregory W. O'Connor
*Attorney, Agent, or Firm*—Norman S. Blodgett

[57] ABSTRACT

Boat stay fastening having a main body extending through the mast and having a hollow cap at each end, the interior of each cap having a spherical surface in which resides a ball adapted to be attached to a stay.

13 Claims, 3 Drawing Figures

BOAT STAY FASTENING

BACKGROUND OF THE INVENTION

Ever since the dawn of history, man has constructed sailboats by running ropes from the upper end of the mast to the periphery of the boat. These ropes are known as "shrouds" or "stays". Although the original stays were formed of fiber rope, many years ago these were replaced by steel wire rope. More recently, a solid rod of a high tensile-strength metal, such as titanium, has been used. Whether the stay be made of solid rod or wire rope, there is a considerable problem in attaching it to the upper end of the mast. This has been done in the past by using a so-called "tang" which is nothing but a metal tab screwed to the mast. Various problems result from the use of this attachment, particularly when it is considered that the tension in the stay may be as high as 3,000 lbs. Furthermore, if a wooden mast is used, the penetration of screws and bolts into the wood permits the introduction of water and the subsequent deterioration of the wood, leading some times to the tang pulling loose when the stay is heavily stressed, as in a storm. If the mast is of the hollow tubular type formed of a light-weight metal, such as aluminum or magnesium, it is difficult to provide fasteners which attach to the metal and which will not deform the metal and pull loose under stress. These and other difficulties experienced with the prior art devices have been obviated in a novel manner by the present invention.

It is, therefore, an outstanding object of the invention to provide a boat stay fastening in which stress applied to the stay is evenly distributed throughout the entire section of the mast to which the stay is attached.

Another object of this invention is the provision of a boat stay fastening which is capable of use with either a wooden mast or a hollow tubular metal mast and which is capable of use with either a wire rope stay or a solid rod stay.

A further object of the present invention is the provision of a boat stay fastening in which the major elements can be applied to a mast without the stay being present and wherein the stay can be applied readily and quickly at a later date.

It is another object of the instant invention to provide a boat stay fastening in which the stay is not subjected to reverse bending during movement of the mast.

A still further object of the invention is the provision of a boat stay fastening containing a degree of universal movement to relieve high-frequency bending stress in the stay.

With these and other objects in view, as will be apparent to those skilled in the art, the invention resides in the combination of parts set forth in the specification and covered by the claims appended hereto.

SUMMARY OF THE INVENTION

In general, the invention consists of a boat stay fastening having an elongated main body adapted to extend through the upper portion of a boat mast, having a hollow cap adapted to be fastened to one end of the main body, the cap having a generally spherical inner surface and having an aperture. A ball having the same radius of curvature as the surface is carried in the cap and has a diametral bore adapted to carry the end of a stay extending through the aperture.

More specifically, the spherical inner surface of the cap has its center of curvature closely adjacent to the outer surface of the mast. The bore in the ball has a counterbore into which the stay is headed. The slot is approximately the width of the stay thickness and extends from a first position in which the stay extends out of the cap axially of the main body to a second position at which the stay is at a small acute angle to the surface of the mast.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
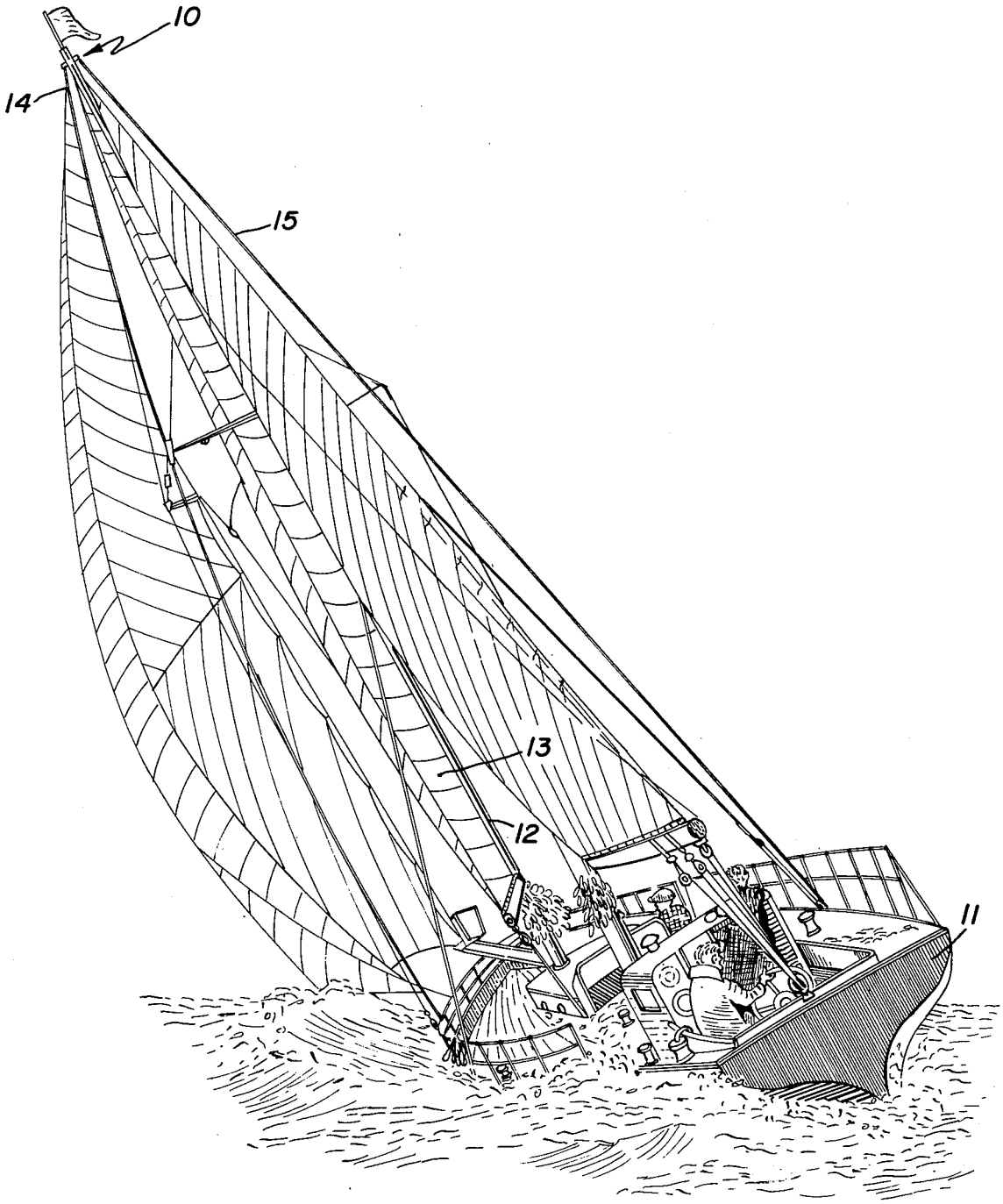
FIG. 1 is a perspective view showing a boat stay fastening incorporating the principles of the present invention and shown in use with a sailing boat.

Referring first to FIG. 1, wherein are best shown the general features of the invention, the boat stay fastening, indicated generally by the reference numeral 10, is shown in use with a sailboat 11, having a mast 12 on which is supported a sail 13. Extending downwardly from the top of the mast 12 to the periphery of the hull of the boat is a port stay 14 and a starboard stay 15. These stays are connected at their lower ends to the hull by turnbuckles (not shown) in the usual way, while at the upper end they are connected to the mast through the fitting 10.

Figure 2:
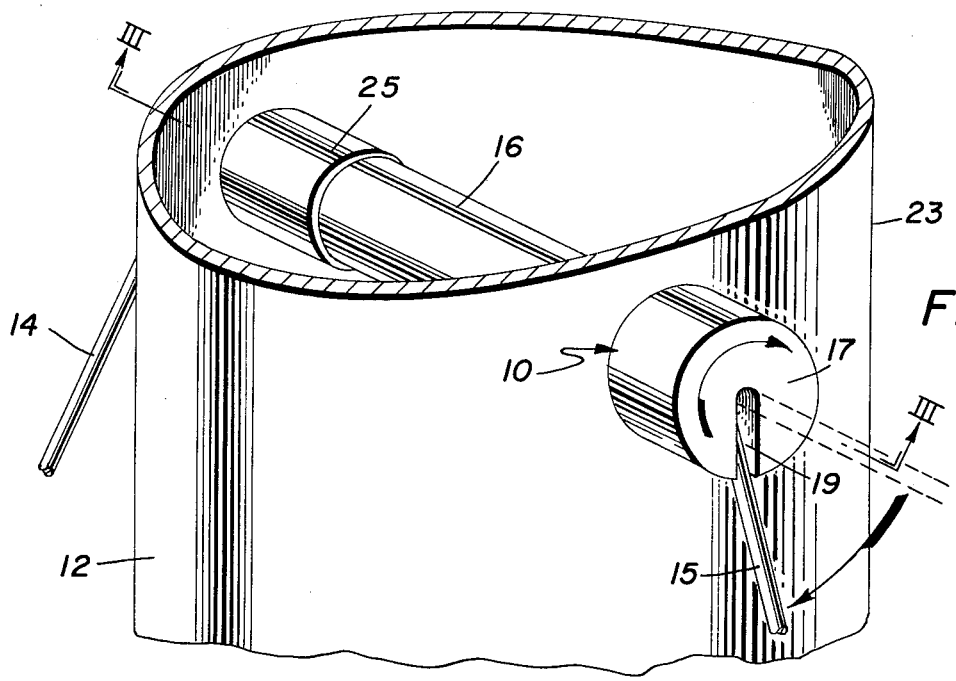
FIG. 2 is an enlarged perspective view of a portion of the boat showing the boat stay fastening in detail.
Figure 3:
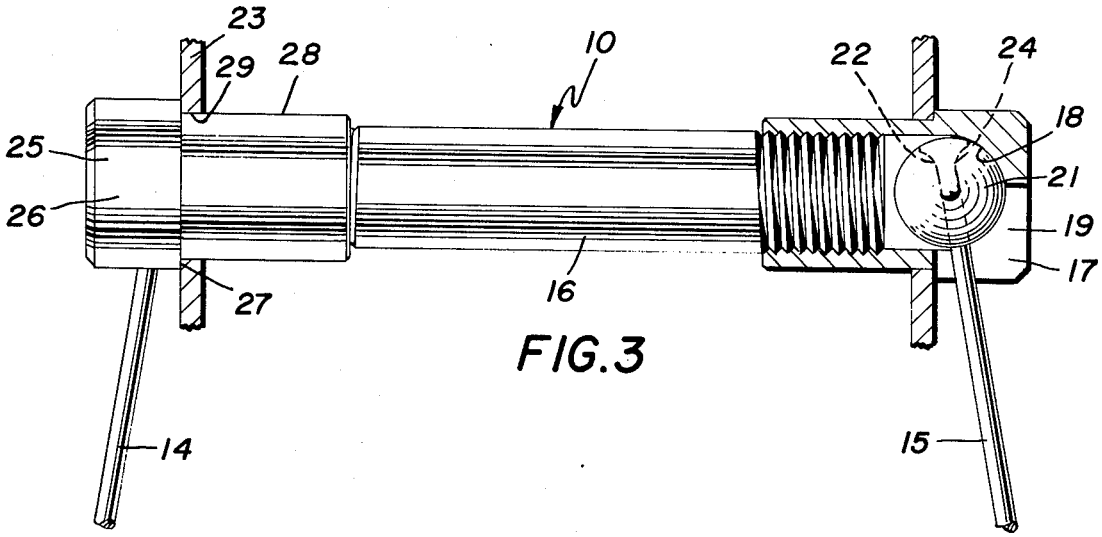
FIG. 3 is a vertical sectional view of the fastening taken on the line III—III of FIG. 2.

Referring to FIGS. 2 and 3, the fitting 10 is shown as having an elongated main body 16 which extends through the upper portion of the boat mast 12. A hollow cap 17 is fastened to one end of the main body 16, the cap being hollow and having a generally spherical inner surface 18. An aperture 19 leads from the exterior of the cap to the spherical surface. A ball 21 having the same diameter as the surface 18 is carried in the cap and has a diametral bore 22 adapted to carry the end of the stay to the aperture.

The mast 12 is tapered and hollow and has an outer surface 23 which (in the limited area involved here) is substantially cylindrical. The center of curvature of the spherical surface 18 is closely adjacent to this outer surface 23 of the mast and this point is also the location of the center of the ball 21. As is evident in FIG. 3, the bore 22 in the ball 29 is provided with a counterbore 24 receiving an enlarged or headed part of the stay 15. The manner of inner engagement of the headed stay and the bore and counterbore in the ball is shown and described in the patent of King, U.S. Pat. No. 3,874,805 which issued on Apr. 1, 1975.

In the preferred embodiment the mast is shown formed as an aluminum tube of circular cross-section and the main body 16 extends diametrically across it with the previously described cap 17 screwed to one end and a similar cap 25 threadedly mounted on the other end. The cap 25 has an enlarged portion or head 26 defining a shoulder 27 which engages the outer surface 23 of the mast. The other cap 17 is similarly formed with an enlarged head and a shoulder engaging the surface of the mast.

The slot 19 formed in the head 17 has a width only slightly larger than the diameter of the stay 15 which extends through it. The slot extends entirely radially through the wall of the cap from the outer surface of the head to the inner spherical surface 18. The extent of the slot is sufficient to allow the stay to swing from a first position (shown in dotted lines in FIG. 2) in which the axis of the stay is coaxial of the axis of the main body 16 to a second position (shown in solid lines in FIG. 2) in which the axis of the stay extends at a very small acute angle to a generatrix of the cylindrical surface 23 of the mast. The slot on the cap 25 is similarly formed. The cap 25 is provided with a reduced portion or neck 28 which extends away from the shoulder 27 and extends through a circular aperture 29 through the wall of the mast; the cap 17 is similarly formed.

As is evident in FIG. 3, the portions of the caps 17 and 25 which threadedly engage the main body 16 lie entirely within the hollow of the mast and, therefore, are protected from exposure to the deleterious effects of the weather.

The operation of the apparatus will now be readily understood in view of the description. In order to apply the fitting to the mast, the apertures 29 are drilled through the mast. The stay 15 is passed through the bore in the ball 19 and is headed to fit the counterbore. The stay is then threaded through the slot and pulled through until the ball rests within the cap. The main body 16 is then screwed into the cap as far as possible without hindering the movement of the ball in the socket. The main body will be selected of a size dependent on the diameter of the mast. The main body 16 is then passed through one of the apertures until the shoulder of the cap 17 rests against the mast. Then, the stay 14 and its ball are placed in the other cap 25 and the cap is introduced into the other aperture 29 in the mast and threaded to the main body 16. The second cap can be screwed on without rotating the entire stay as long as the stay leads straight out of the cap, as shown in dotted lines in FIG. 2. Normally, the caps would be tightened until their shoulders are snug against the mast and then backed off one complete turn so that the balls are free in their caps. The other end of the stays are then attached to the hull of the boat by the usual turnbuckles and fittings.

The advantages of the present invention will be evident from the above description. One decided advantage is that, after the caps have been properly tightened (with the stay extending axial of the main body), the stay is then moved downwardly in the slot so that it extends at an acute angle to the axis of the mast. In this position it prevents the cap from turning, so that, once the fitting has been attached to the mast, it is impossible for it to unthread due to movement of the stays and masts in the wind. The fact that the threads are located within the mast means that they are protected from the deleterious effects of salt, air, rain, and the like. Because of the ability of the balls on the ends of the stays to move within the caps, the force in the stay acts on the mast almost entirely in compression. This is particularly important in the case of a thin walled tube of light metal, which wall is easily deformed when subjected to bending by a force couple, but which is capable of withstanding fairly high compressive stresses. So far as the stays themselves are concerned, any movement that is necessary because of relative movement of the stays and masts is compensated for by the sliding action of the surface of the ball on the spherical surface of the interior of the cap. In general, it might be said by use of the present fitting, all of the forces between the stays and the masts are evenly distributed which is in direct contrast, for instance, to the situation where a tang is fastened to a mast by use of screws or bolts and the forces are concentrated on the area occupied by those screws. The present fastening, therefore, is a light-weight, low-drag, tang or terminal for a sailing boat stay which provides toggling action to minimize cyclic stresses on the stay.

The present invention is also useful in connection with an aluminum mast, because it permits a welded compression tube to be eliminated. The large diameter of the cap provides more bearing area than a small through-bolt. It is the requirement for bearing area (rather than compressive mast loading) that makes the compression tube necessary. This, plus the elimination of an expensive sheet metal tang makes this new fitting so beneficial.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Boat stay fastening, comprising:

a. an elongated main body adapted to extend through the upper portion of a boat mast, b. a hollow cap adapted to be fastened to one end of the main body, the cap having a generally spherical inner surface and having an aperture, and c. a ball carried in the cap and having a diametral bore adapted to carry the end of a stay extending through the aperture, the main body extending diametrically across the mast with the aforementioned cap at one end and a second, similar cap at the other end, each cap being threadedly mounted on its end of the main body.

2. Boat stay fastening as recited in claim 1, wherein the mast is hollow and has an outer generally cylindrical surface, wherein the spherical inner surface of the cap has its center of curvature closely adjacent to the outer surface of the mast, and wherein the ball has the same radius as the sperical surface.

3. Boat stay fastening as recited in claim 1, wherein the bore in the ball has a counterbore into which the stay is headed.

4. Boat stay fastening as recited in claim 1, wherein each cap has a head with a shoulder normally engaging the outer surface of the mast.

5. Boat stay fastening as recited in claim 4, wherein a slot is formed in each head, the slot having a width at least as large as the diameter of the stay, wherein the slot extends entirely through the wall of the cap from the outer surface of the head to the spherical inner surface, extent of the slot being sufficient to allow the ball and stay to swing from a first position in which the stay is coaxial of the main body to a second position in which stay extends at an acute angle to a generatrix of the outer surface of the mast.

6. Boat stay fastening as recited in claim 4, wherein each cap has a portion of reduced diameter extending away from the shoulder of the head, wherein the mast is provided with an aperture in which the reduced portion fits snugly, and wherein the main body and its threaded ends lie entirely within the mast.

7. Boat stay fastening, comprising a. an elongated main body extending through the upper portion of a boat mast, b. a hollow cap fastened to one end of the main body, the cap having a generally spherical inner surface and having an aperture, and c. a ball carried in the cap and having a diametral bore in which lies the end of a stay extending through the aperture.

8. Boat stay fastening as recited in claim 7, wherein the mast is hollow and has an outer generally cylindrical surface, wherein the spherical inner surface of the cap has its center of curvature closely adjacent to the outer surface of the mast, and wherein the ball has the same radius as the spherical surface.

9. Boat stay fastening as recited in claim 7, wherein the bore in the ball has a counterbore into which the stay is headed.

10. Boat stay fastening as recited in claim 7, wherein the boat mast is a metal tube, wherein the main body extends diametrically across the mast with the aforementioned cap at one end and a second, similar cap at the other end, each cap being threadedly mounted on its end of the main body.

11. Boat stay fastening as recited in claim 10, wherein each cap has a head with a shoulder normally engaging the outer surface of the mast.

12. Boat stay fastening as recited in claim 11, wherein a slot is formed in each head, the slot having a width at least as large as the diameter of the stay, wherein the slot extends entirely through the wall of the cap from the outer surface of the head to the spherical inner surface, the extent of the slot being sufficient to allow the ball and stay to swing from a first position in which the stay is coaxial of the main body to a second position in which stay extends at an acute angle to a generatrix of the outer surface of the mast.

13. Boat stay fastening as recited in claim 11, wherein each cap has a portion of reduced diameter extending away from the shoulder of the head, wherein the mast is provided with an aperture in which the reduced portion fits snugly, and wherein the main body and its threaded ends lie entirely within the mast.

* * * * *